United States Patent [19]

Grabovac et al.

[11] 4,429,597

[45] Feb. 7, 1984

[54] HYDRAULIC TORQUE WRENCH

[75] Inventors: Bosko Grabovac, Arcadia; Ivan N. Vuceta, Walnut, both of Calif.

[73] Assignee: Consolidated Devices, Inc., City of Industry, Calif.

[21] Appl. No.: 338,068

[22] Filed: Jan. 8, 1982

[51] Int. Cl.[3] ..... B25B 13/00

[52] U.S. Cl. ..... 81/57.39

[58] Field of Search ..... 81/57.39; 74/833, 522; 192/46

[56] References Cited

U.S. PATENT DOCUMENTS

| | | | |
|---|---|---|---|
| 1,812,816 | 6/1931 | Weaver | 81/57.39 |
| 2,030,571 | 2/1936 | Cawley | 74/833 |
| 3,745,858 | 7/1973 | Biach | 81/57.39 |
| 4,269,088 | 5/1981 | Dukes | 81/57.39 |

*Primary Examiner*—James L. Jones, Jr.

[57] ABSTRACT

A pneumatically driven power torque wrench comprising an elongate frame with front and rear ends, a transversely extending drive shaft rotatably carried by the frame at the front end thereof; a ratchet drive to rotate the shaft and including a ratchet wheel on the shaft; a drive ring about the wheel; circumferential pawls between the wheel, the ring and an elongate lever arm projecting from said ring. The wrench further includes a cylinder and ram unit fixed to and extending between the lever arm and the rear end of the frame and a work-engaging tool carried by the shaft, at one end thereof, and engaging a fastener concentric therewith. The wrench next includes a reaction device to anchor the rear end of the frame against rotation about the axis of the shaft. The reaction device includes a pair of elongate laterally spaced shackle plates with forward ends pivoted to the rear end of the frame; an elongate tubular body fixed to and extending between the rear free ends of the plates and an elongate post slidably engaged trough and projecting from the ends of the body and having work-engaging coupling parts at its opposite ends. A work-engaging tool is coupled with one end of the post and is engaged with a fastener spaced from the fastener aligned with the shaft. The post is shiftable axially so that the body, post and fastener are in axial alignment when the drive shaft is in axial alignment with the fastener related to it.

13 Claims, 10 Drawing Figures

Fig. 5.
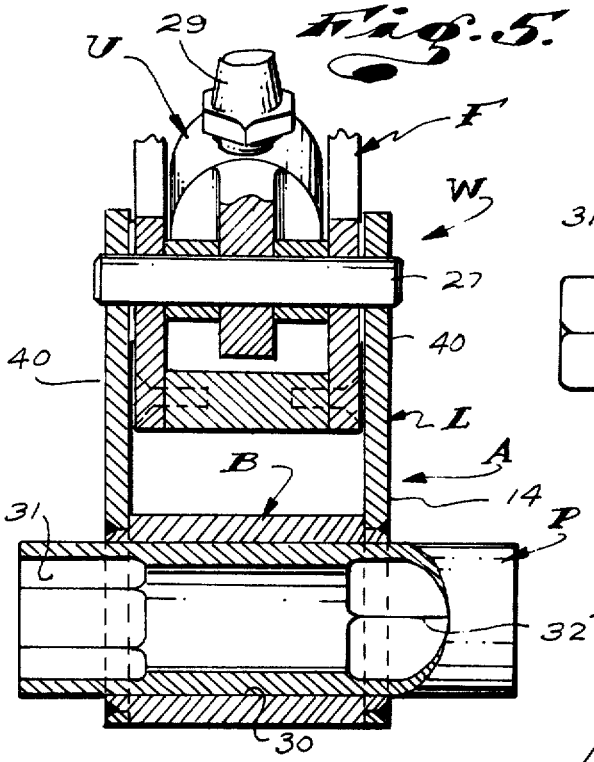
Fig. 10.
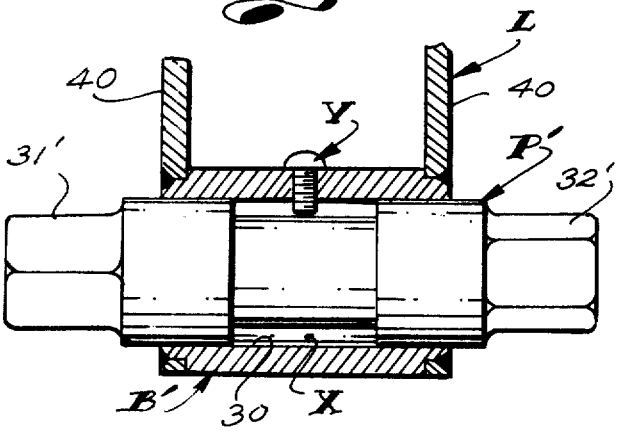
Fig. 7.
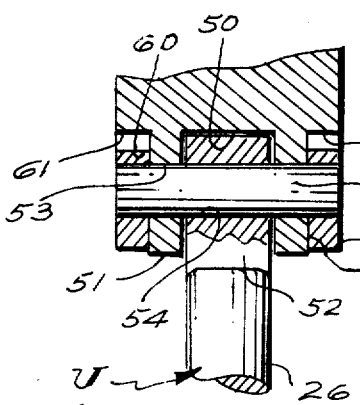
Fig. 8.
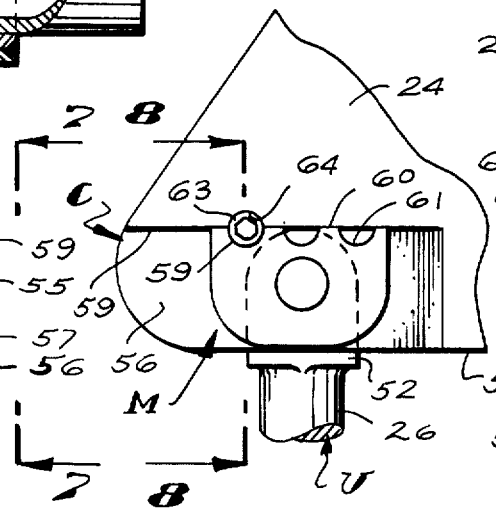
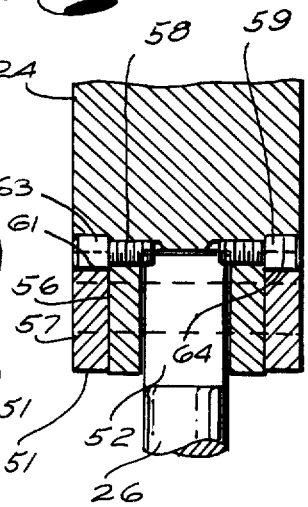
Fig. 6.
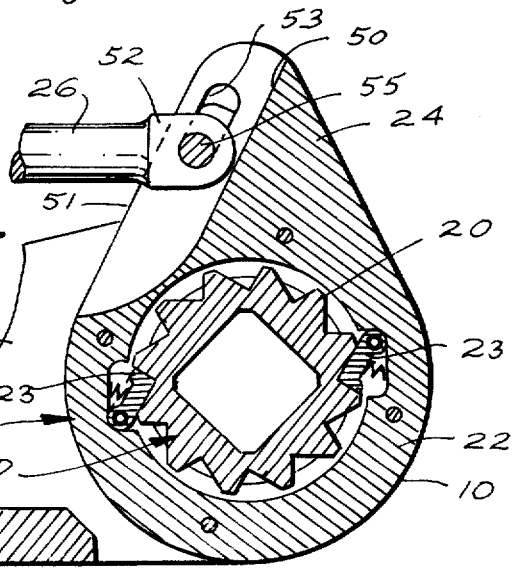
Fig. 9.

HYDRAULIC TORQUE WRENCH

This invention has to do with a hydraulic powered torque wrench and is particularly concerned with a wrench having novel reaction anchoring and power modifying structure.

BACKGROUND OF THE INVENTION

In the art of torque applying tools for tightening screw fasteners and the like, it is common practice to provide and use tools which are such that the torsional forces applied to fasteners worked upon is known, limited and/or controlled. Such tools or wrenches are commonly qualified as "torque wrenches".

In the art of torque wrenches, there is a special class of torque wrench commonly called "power torque wrenches". Power torque wrenches are pneumatically or hydraulically powered tools which characteristically include elongate rigid frames, power output shafts extending transverse of and rotatably carried by the frames at one end thereof, ratchet drive means carried by the shafts to establish rotary driving engagement therewith when turned in one direction and which have lever arms projecting radially outwardly therefrom; and pneumatic or hydraulic cylinder and ram units connected with and between the ends of the lever arms of the ratchet means and the other ends of the frames. The output shafts of such power torque wrenches carry work or fastener engaging tools, such as fastener head engaging sockets, at one of their ends. Such sockets or fastener engaging tools, while commonly separable from their related shafts, are, when engaged therewith, considered a part of their related shafts or wrench structures.

The mechanical geometry of power torque wrenches of the character described above is substantially fixed and the power rating of the cylinder and ram units thereof is substantially fixed. Accordingly, the power output or torsional forces delivered by the output shafts of such wrenches is substantially directly proportional to the pressure on the motive fluid medium delivered to the cylinder and ram units. By delivering motive fluid to the cylinder and ram units of such wrenches at selected pressures, the torsional forces delivered by the wrench structures onto related fasteners or the like is predetermined and known.

In using such wrenches, their output shafts, with related fastener engaging tools or sockets coupled therewith, are arranged in axial alignment with headed fasteners to be worked upon, with the tools or sockets engaged with the heads of the fasteners. The frames of the wrenches are then suitably stopped to prevent their rotation about the axes of the fasteners and to assure that necessary reaction through and between the wrench structures and the fasteners is attained. Thereafter, motive fluid is intermittently delivered to and exhausted from the cylinder and ram units to effect reciprocating operation thereof, oscillating rotary driving of the ratchet means and resulting intermittent rotary driving of the assembled and engaged shafts sockets and fastners.

For effective use and operation of power torque wrenches of the character referred to above, it is highly important that axial alignment of the output shaft and the fasteners worked upon be established and maintained. Any substantial misalignment of the shafts, sockets and/or fasteners resulting in any notable relative movement and/or binding therebetween materially alters the torque delivered by the output shafts to the fasteners and renders the wrenches incapable of applying known predetermined forces onto and through the fasteners. Further, if the shafts, sockets and fasteners are sufficiently misaligned to cause binding and relative working between the related parts, the exerting of high forces therebetween often results in extensive and irreparable damage to the noted related parts.

In practice, stopping the frames of power torque wrenches against rotation relative to the fasteners worked upon and to thereby attain necessary reaction in and through the wrench structures and fasteners often presents special problems. When the fasteners worked upon are close to strong and structurally sound supporting structures against which the wrench frames can be stopped, little difficulty exists in effectively stopping the frames. However, where no available or suitable stopping or reacting structures are available to engage and stop the wrench frames, special and oftentimes costly and difficult to use stop and/or anchoring means and structure must be devised and used to stop the wrench frames.

It has been determined that in the great majority of situations where power torque wrenches are used, there exists a plurality of spaced apart headed screw fasteners which must be worked upon or tightened and that by providing and using suitable anchoring mechanisms attached to the torque wrench structures and engageable with selected fastener heads in a series or group of related fasteners, can effectively serve to anchor and stop the frames of the wrenches, as desired. One such anchoring mechanism provided by the prior art comprises an elongate link having one end pivotably connected with the free end of its related power torque wrench frame, remote from the drive shaft of the wrench, and having a fastener head engaging socket fixed to its other end. With this anchoring attachment related to and made a part of a power torque wrench structure, the wrench structure is related to and engaged with a first screw fastener to be tightened in a regular manner such as described above and the wrench frame and the like of the anchoring mechanism are pivoted to align the socket on the link with the head of another or second available fastener head and the socket is moved into engagement with that head; thereby effectively anchoring and stopping the frame, preparatory to operating the wrench and tightening the first fastener.

While the above noted type of anchoring mechanism or attachment for power torque wrenches has proven to be effective in a notable number of frequently encountered situations, it has proven to be so undependable in a sufficient number of instances to cast serious doubts regarding its general utility. The principal shortcoming found to exist in the use of the above noted form of anchoring mechanism resides in the fact that when wrenches with such anchoring mechanisms related to them are engaged with and between first and second fastener heads, as noted above, and the fastener heads are on spaced apart planes, necessary alignment of the fasteners with their related parts of the wrench structures and anchoring mechanisms cannot be attained. That misalignment of parts which oftentimes exists is sufficient to cause a binding of parts which prevents the wrenches from operating properly, and results in damage to the fasteners and to the parts and/or portions of the wrench structures related thereto.

In accordance with the above, a prerequisite to the effective and safe use of the above noted form of anchoring mechanisms for power torque wrenches is that the pairs of fastener heads with which the wrenches and anchoring mechanisms are related be on a common plane or be so close to a common plane that misalignment of the several related parts cannot or is not likely to occur.

It has been determined that when a power torque wrench with an anchoring mechanism of the character referred to above is engaged with and between a pair of related fastener heads entered into a common surface of a related structure, one of the fasteners is fully engaged in that structure and the other fastener is just entered into that structure, the heads of the fasteners most often occur on different planes which are spaced apart a sufficient distance to prevent necessary alignment of parts and safe operation of the wrench structure.

OBJECTS AND FEATURES OF THE INVENTION

An object of our invention is to provide an improved reaction anchoring means for power torque wrenches.

It is an object and feature of our invention to provide a reaction anchoring means including an elongate axially shiftable fastener head engaging means carried by the wrench frame in radial spaced relationship from the axis of the output shaft of the wrench and a first headed fastener concentric therewith and engaged thereby, whereby said fastener engaging means can be moved axially to engage the head of a second fastener on an axis concentric therewith and which is on a radial plane spaced axially from the radial plane on which the head of the first fastener occurs.

Yet another object and feature of the invention is to provide a reaction anchoring means of the character referred to above wherein said fastener head engaging means includes a pair of elongate axially shiftable telescopically engaged parts carried by the outer end of an elongate link structure pivotally connected with and projecting from the wrench frame at a location spaced radially from the axis of the output shaft whereby the frame can be pivoted about the axis of the said first fastener and the link structure can be pivoted relative to the frame to move the fastener head engaging means into axial alignment with a second headed fastener spaced from the first fastener within that area about the first fastener which can be circumscribed by the fastener head engaging means upon relative pivotal movement of the link means relative to the frame and of the frame relative to said first fastener.

Another object and feature of my invention is to provide a reaction anchoring means of the character referred to wherein said fastner head engaging means includes an elongate outer tubular body, an elongate post rotatably and slidably engaged in and carried by the body and carrying a fastener engaging tool or socket at one of its ends; a pair of elongate parallel shackle plates with outer ends fixed to opposite ends of the body and having inner ends pivotally coupled with the power torque wrench frame on an axis parallel with and spaced from the axis of the output shaft.

It is an object and feature of the invention to provide reaction anchoring means of the character referred to above which is easy and economical to manufacture; easy and convenient to relate or attach to a related power torque wrench; and which is durable and highly effective in operation.

A further object and feature of the present invention is to provide a power torque wrench of the character referred to in the foregoing which includes novel coupling means to drivingly couple an end of the ram of the cylinder and ram unit with the outer end portion of the lever arm of the ratchet means, which coupling means provides for selective positioning of the end of the ram longitudinally of the lever arm or radially relative to the rotative axis of the ratchet means, whereby the mechanical advantage and power output of the wrench structure can be varied and set, as desired or as circumstances require.

The foregoing and other objects and features of our invention will be fully understood from the following detailed description of our invention throughout which description reference is made to the accompanying drawings.

DESCRIPTION OF THE DRAWINGS

FIG. 5 is a sectional view taken substantially as indicated by line 5—5 on FIG. 1;

FIG. 6 is a view taken substantially as indicated by line 6—6 on FIG. 1;

FIG. 7 is a view taken as indicated by line 7—7 on FIG. 6;

FIG. 8 is a view taken as indicated by line 8—8 on FIG. 7;

FIG. 9 is a sectional view of a portion of the wrench showing the ratchet mechanism; and FIG. 10 is a view of another form of our invention.

DETAILED DESCRIPTION OF THE INVENTION

Figure 1:
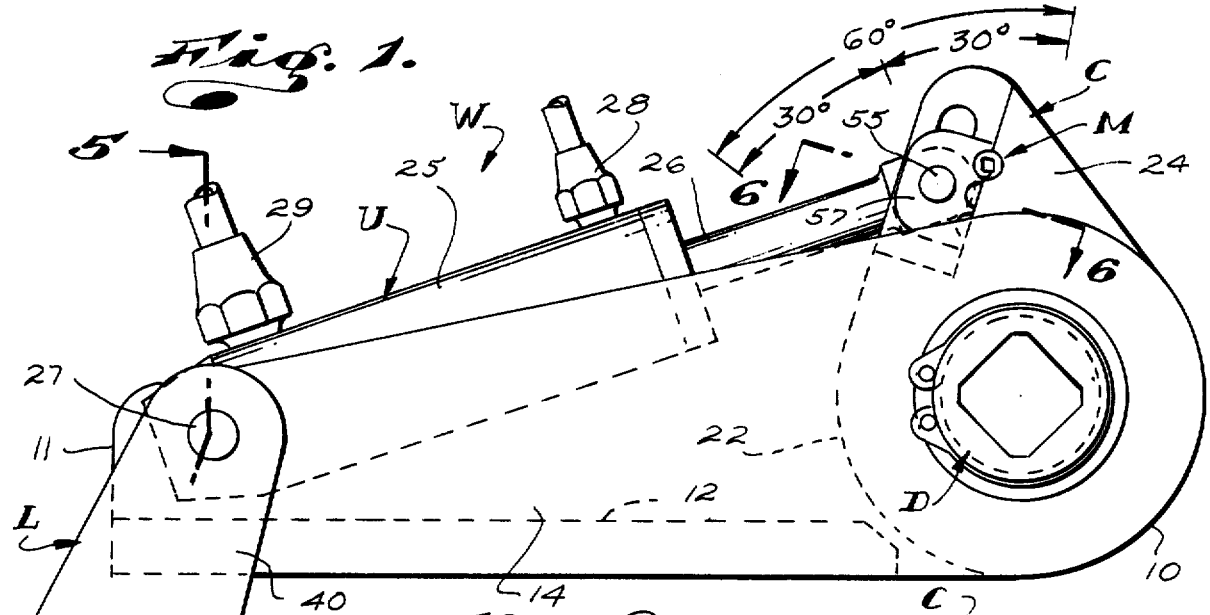
FIG. 1 is an elevational view of a power torque wrench with our reaction anchoring means and variable coupling means embodied therein.

In the drawings we have elected to show our new reaction anchoring means A related to a typical power torque wrench structure W, hereinafter called the "wrench". The wrench W includes an elongate frame F with front and rear ends 10 and 11. The frame F includes a flat horizontal longitudinally extending bottom wall 12 and a pair of laterally spaced, longitudinally extending, vertical side walls 14. The side walls 14 are shown as having forward end portions projecting axially forward from the forward end of the bottom wall 12. The walls 12 and 14 cooperate to define an elongate upwardly and axially opening channel.

The wrench W next includes an elongate tubular drive shaft D extending laterally or transverse the longitudinal axis of the frame F. The shaft D has opposite ends suitably engaged in and projecting through a pair of axially aligned openings in the forward end portions of the side walls 14 of the frame. The shaft D has an elongate central polygonal opening at one or both of its ends in which the polygonal drive lug 15 of a fastener engaging socket 16 (or other suitable fasteners or work-engaging tool) is engaged. The socket 16 is concentric with and opens axially outward relative to its related end of the shaft D. The socket 16 (or whatever work-engaging tool might be used) can and will be considered a part of the shaft D for the purpose of this disclosure.

The wrench W next includes ratchet means R for rotating the shaft D relative to the former F (see FIG. 9). The ratchet means R is shown as including an annular ratchet wheel 20 having a plurality of circumferentially spaced radially outwardly projecting teeth engaged about and carried by the shaft D between the ends thereof and between the side walls 14 of the frame F. The ratchet means R next includes an annular sleeve-like drive ring 22 engaged freely about the ratchet wheel 20 and between the side walls 14 of the frame F and a multiplicity of spring-loaded ratchet pawls 23 pivotally carried by the ring 22 and normally projecting circumferentially and radially between the ring and the wheel to releasably establish driving engagement therebetween. The sleeve-like ring 22 has an elongate radially outwardly (substantially upwardly) projecting lever arm 24.

The wrench W next includes an elongate longitudinally extending cylinder and ram unit U with a rear elongate cylinder 25 and a forward elongate ram 26 projecting forwardly from the cylinder 25. The unit U is arranged to extend longitudinally in the channel defined by the frame F. The rear end of the cylinder 25 is pivotally connected with the rear end of the frame F by an elongate laterally extending pivot pin 27 having opposite end portions projecting through aligned openings in the side walls 14 of the frame and projecting laterally outwardly from the frame. The rear end of the cylinder 25 is provided with an apertured block in and through which the pin 27 extends. The cylinder 25 has front and rear fluid fittings 28 and 29 to facilitate delivery of motive fluid into and out of the opposite end portions thereof to effect desired reciprocating movement of the ram 26. The forward end of the ram 26 is drivingly coupled with the upper or outer free end portion of the lever arm 24 of the ring 22 of the means R by novel coupling means C, the details of which means will be fully described in the following:

The teeth of the ratchet wheel 21 and the pawls 23 of the means R are designed and arranged so that when the drive ring 22 is driven and rotated clockwise by forward movement of the lever arm, driving engagement between the ring 22 and the wheel and drive shaft assembly is established and so that when the ring is driven or rotated counter-clockwise by the unit U, driving engagement between the ring 22 and the ratchet wheel and drive shaft assembly is broken. Accordingly, upon operation of the unit U and the reciprocating movement of the ram 26 thereof, the drive shaft D is effectively intermittently rotated in a clockwise direction.

In the case illustrated, the stroke of the cylinder and ram unit and the length of the lever arm are such that the drive shaft is rotated approximately 60° each time the ram is moved from its rearmost to its foremost position. The travel of the arm is slightly greater than the driven motion of the shaft to aaaure proper engagement and disengagement of the pawls with the teeth.

The wrench structure W illustrated and briefly described above is typical of the type and/or class of power torque wrench with which our new reaction anchoring means A and coupling means C can be advantageously related.

The reaction anchoring means A that we provide includes an elongate laterally extending tubular body B with opposite open ends and a straight cylidnrical bore 30; an elongated cylindrical post P, greater in longitudinal extent than the body B, is slidably engaged in and carried by the body. The post P has elongate longitudinally outwardly opening central polygonal socket openings 31 and 32 entering its opposite ends. The socket opening 31 is shown as a hexagonal socket opening and the socket opening 32 is shown as a square socket opening. In use, a fastener head or work-engaging tool 16', with a polygonal drive lug 15', is related to the post to become a part of the means A when in use. The tool 16' can be any suitable work-engaging tool and is shown as a fastener head-engaging socket, similar to the socket 16 related to the drive shaft D of the wrench W. The socket or tool 16' is arranged in axial alignment with the post, at one end thereof, with its lug 15' releasably engaged in the socket opening entering said one end of the post.

It is to be noted that the post P is slidably engaged in the body B and is such that it can be slidably removed from within the body, turned end to end and rearranged in the body so as to arrange the dissimilar polygonal socket openings 31 and 32 at those sides of the wrench structure which circumstances require.

In addition to the foregoing, the reaction anchoring means A includes elongate link means L pivotally coupling the body B with the rear end of the frame F of the wrench W. The link means L is shown as including a pair of elongate laterally spaced parallel shackles or shackle plates 40 with apertured outer end portions receiving and auitably fixed to related ends of the body B and inner free ends occurring adjacent the outwardly disposed outer sides or surfaces of the side walls 14 of the frame F, at the rear end portions thereof.

In the form of the invention illustrated, the inner ends of the shackle plates 40 have openings in and through which the opposite end portions of the pivot pin 27 for the unit U of the wrench W are slidably engaged to effectively pivotally couple those plates to the frame. While utilizing the pivot pin 27 to couple the plates 40 to the frame F is most practical in the form of the invention illustrated, it will be apparent that one or a pair of separate pivot pins or some other and special form of hinge means might be employed to couple the plates 40 to the frame F without departing from the broader aspects and spirit of our invention.

Figure 3:
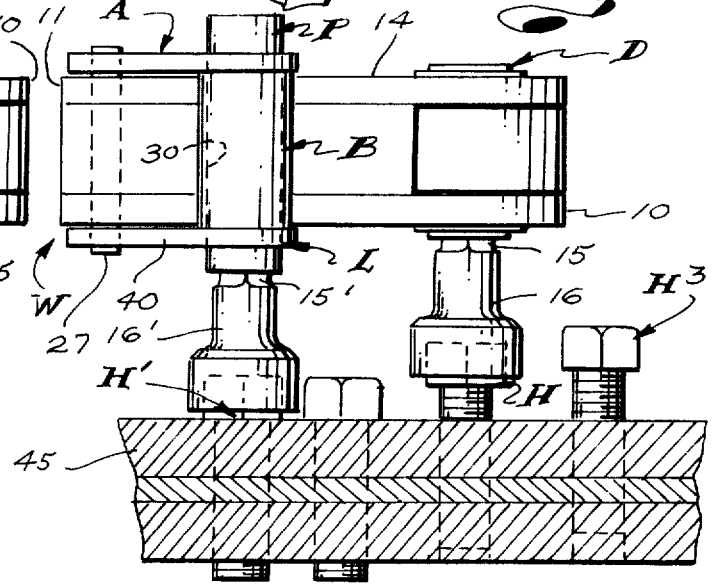
FIG. 3 is a view taken substantially as indicated by line 3—3 on FIG. 2.

With the means A illustrated and described above, it will be apparent that upon axial shifting of the post P in the body B of the means A, the socket 16' thereof or related thereto can be moved laterally inwardly and outwardly relative to the central longitudinal axis of the wrench W and relative to the socket 16 of or related to the drive shaft D of the wrench W, as clearly shown in FIG. 3 of the drawings. With this capability, and as shown in FIG. 3 of the drawings, when the sockets 16 and 16' are engaged with a pair of spaced apart fastener heads H and H', the radial planes of which are axially spaced one from the other, the central axes of the realted sockets and fasteners are easily and conveniently maintained parallel at all times, thus assuring proper operation of the wrench W and avoiding that damage to the fasteners and/or to the wrench structure which would likely occur if the sockets and fasteners were to become misaligned.

In furtherance of our invention, with the reaction anchoring means A provided, the distance between the socket 16 and 16' can be varied and/or adjusted throughout a wide range to effect aligning and subsequent engagement of the sockets 16 and 16' with different pairs of fastenrs spaced different distances apart. Referring to and comparing FIGS. 2 and 3 of the drawings, it will be apparent that the annular disposition of the frame F and shackle plates 40 is such that the sockets 16 and 16' are effectively aligned and engaged with the heads H and H' of the screw fasteners accessible at the outside face of a pipe flange 45. Such alignment is attained by first engaging the socket 16 with its related head H and then pivoting the frame F relative to the fastener H and pivoting the shackle plates 40 relative to the frame F to move the socket 16' into alignment with the fastener head H'. It will be apparent that so long as the distance between the heads H and H' is not outside the wide range of adjustment afforded by our construction, alignment of the sockets and heads can be easily and quickly attained, in the above manner, regardless of the distance between the heads.

Figure 2:
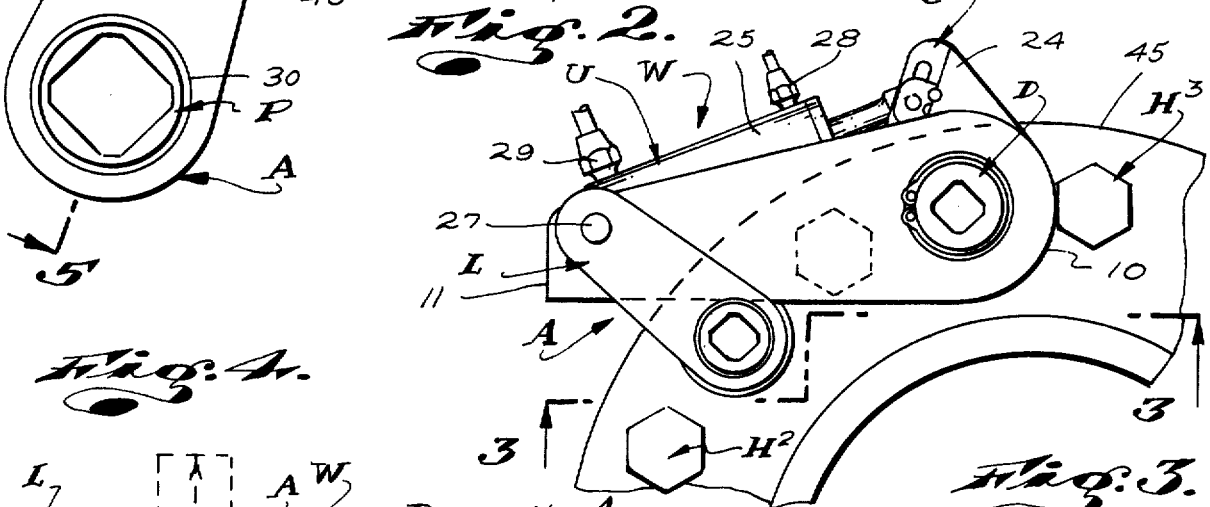
FIG. 2 is a view of reduced scale showing the wrench structure related to work.

Referring to FIGS. 2 and 3 of the drawings, it will be apparent that if desired, the socket 16' could be aligned and engaged with the fastener head $H^2$, by pivoting the shackle plates 40 down and to the left and pivoting the frame F downwardly and rearwardly relative to the axis of the fastener H, with which the socket 16 is related. In addition, to the above, or alternatively, by similar pivotal movement and adjustment of parts, the socket 16 at the forward end of the frame F could be moved to the right, into alignment and engagement with the fasteners $H^3$ which is spaced to the right of the fastener H.

It will be apparent from the above that with the means A that we provide, the range of adjustment between maximum and minimum spacing of the sockets 16 and 17' (or of their related drive shaft D and post P) is substantial and is such that the wrench W, with our means A related to it, can be conveniently engaged with and between pairs of fasteners in a very large number of those instances where series of spaced apart fastenrs are presented and accessible at a common plane or surface of their related structures.

Figure 4:
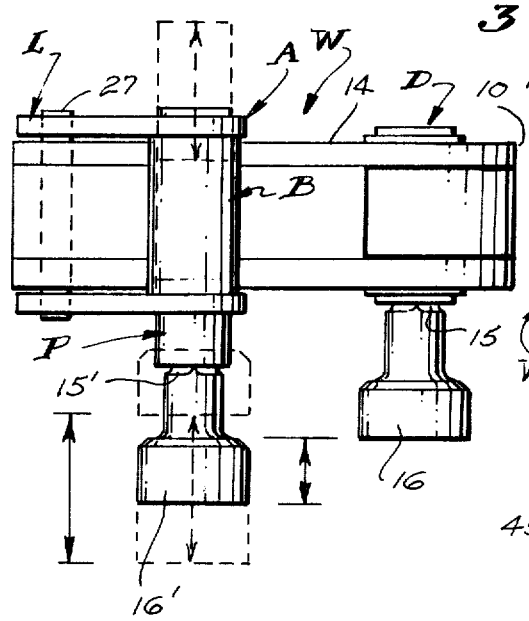
FIG. 4 is a view of the wrench structure shown in FIG. 3 with parts in other positions.

In practice, and as shown in FIGS. 3 and 4 of the drawings, many sockets and similar work-engaging tools have elongate cylindrical shanks between their polygonal lugs and sockets or work-engaging portions. Those shanks are normally no greater in diametric extent than the major cross-sectional dimension of their polygonal lugs. Accordingly, as shown in dotted lines in FIG. 4 of the drawings, if and when it is necessary to move such work-engaging tools inwardly toward the body B of the means A, the end of the post P with which the tool is related can be moved to occur well within the body B and the shank of the tool can project freely through that portion of the body which is unoccupied by the post.

In practice, and as shown in FIG. 10 of the drawings, the post P' can be a solid bar with polygonal drive members 31' and 32' at its end. Further, as shown at X, the post P' can be of reduced diameter throughout its central portion to define longitudinally inwardly disposed axially spaced stop shoulders and the body B' can carry a stop screw Y which enters the opening 30' between the shoulders and prevents axial displacement of the post from within the body.

The coupling means C that we provide to couple the forward end of the ram 26 of the unit U with the outer end portion of the lever arm 24 on the ring 22 of the ratchet means R includes an elongate substantially vertically extending rearwardly opening channel 50 milled or otherwise formed in the outer end portion of a normally substantially vertically extending, rearwardly disposed rear edge 51 of the lever arm 24. The ram 26 has a head 52 at its forward end arranged within and shiftable longitudinally in the channel 50. The portions of the lever arm at the opposite sides of and defining the channel 50 are provided with elongate normally substantially vertically extending through slots 53 (extending parallel with the channel). The head 52 on the ram 26 has a laterally extending openings 54, the central axis of which is normal to the central longitudinal axis of the slots 53. An elongate coupling pin 55 is slidably and rotatably engaged in and through the opening 54 in the head 52 and has opposite end portions slidably engaged in and projecting laterally outwardly from the slots 53. With the structure of the means C thus far described, it will be apparent that the ram 26 is drivingly coupled with the lever arm 22 and that the distance between the central rotative axis of the ring 22 or ratchet means R and the lever arm 24 thereof and the axis of the coupling pin 55 establishes and/or determines the effective length of the lever arm and the resulting mechanical advantage afforded thereby when the wrench is operated. It will be further apparent that with the structure of the means C thus described, the pivot pin 55 can be moved longitudinally of the slots 53 and the upon such shifting of the pin, the effective length of the lever arm is varied. Accordingly, by shifting of the pin 55 in the manner set forth above, the effective length of the lever arm and the mechanical advantage afforded thereby can be altered, varied or adjusted, as desired or as circumstances require.

In addition to the above, the means C includes releasable lock means M to lock the ocupling pin 55 in desired set position longituidnally of the slots 53 (in set spaced relationship from the rotative axis of the means R). The lock means M can vary widely in form and construction and is shown as including elongate normally substantially vertically extending laterally outwardly opening ways 56 formed in the outside surfaces of the lever arm 26 and plate-like blocks or shoes 57 fixed to the outer ends of the coupling pin 55 and slidably engaged in related ways 56. Finally, the means M includes set screws 58 threadedly engaged in the lever arm 24, at the opposite sides thereof, to releasably engage and retain the shoes in set position, longitudinally of the ways 56.

In the form of the invention illustrated, the ways 56 have flat laterally outwardly substantially vertically extending, rearwardly disposed, longitudinal forward edges 59. The shoes 57 have flat, laterally inwardly disposed inside surfaces slidably engaging the bottom surfaces of the ways and have straight flat forward edges 60 establishing flat sliding and guided engagement with the forward edges 59 of their related ways 56. The forward edge portions of the shoes 57 are provided with a plurality (3) of longitudinally spaced forwardly and laterally opening semicircular set screw receiving notches 61. The notches 61 open at the forward edges 60 of the shoes and oppose the edges 59 of the ways. The set screws 58 are engaged in their related sides of the lever arm with their laterally extending central axes in line with and/or between the opposing edges 59 and 60 of their related ways 56 and shoes 57. The screws are arranged longitudinally of the edges 59 and 60 to occur concentric with a selected one of the several notches 61 in their related shoes. The set screws have threaded shanks engaged in threaded openings in the lever arm, laterally inward of their related ways and have enlarged cylindrical heads 63 corresponding in diameter and in axial extent with the diameter and axial extent of their related notches 61, whereby the rear one-half of the heads normally establish seated engagement in their related notches 61 in the shoes. The other or forward one-half of the set screw heads 63 normally occur in seated engagement in countersink-like laterally outwardly and rearwardly opening notches 64 in the arm 24, at the forward edges 59 of the ways 56, as clearly shown in the drawings.

With the notches 61 and 64 and set screws 58 that we provide, the heads 63 of the screws normally releasably key the shoes 57 in the ways 56 and prevent movement of the shoes longitudinally of the ways. Thus, the coupling pin 55 is effectively retained in set position and the effective length of the lever arm is fixed or set.

Upon turning of the set screws out of engagement and movement of their heads from engagement in one of the notches 61 of the shoes 57, the shoes and their related coupling pin 55 can be moved longitudinally of the ways to selected positions where other of the notches 61 register with the notches 64 and the screws, whereupon the screws can be advanced into set engagement in and with the newly set registered sets of notches 61 and 64, locking the shoes and their related coupling pin in another desired, predetermined, set position in the lever arm.

In practice, the angular disposition of the longitudinal axes of the slots 53 and of the opposing edges 59 and 60 of the ways and shoes is preferably such that when the lever arm is moved back and forth through its normal arc of travel (about 60°), the angular relationship of those slots and edges relative to the central longitudinal axis of the ram 26 is less than 45° (the angle of shear) whereby the forces exerted between the coupling pin 55 and the slots and/or the forces exerted on and between the opposing related edges 59 and 60 of the construction tend to cause the coupling pin and the opposing surfaces or edges of the slots and/or the opposing related edges 59 and 60 to frictionally stop and resist relative movement. With such a relationship, the shearing forces exerted onto and through the set screws 58 and the tendency for the shoes 57 and/or the coupling pin 55 to move from set position, during operation of the wrench, is greatly minimized.

With the lock means M set forth above, by suitably spacing the notches 61 in the shoes 57, the effective length of the lever arm and the mechanical advantage to be afforded by the wrench, between the cylinder and ram unit and the drive shaft D, can be easily and conveniently selected. The ability to selectively alter or vary the effective length of the lever arm in such wrenches is extremely desirable since through such adjustment, a most effective and efficient balance between the supply of pressurized motive fluid used to operate the wrench and the work output of the wrench can be attained.

Having described only one typical preferred form and application of our invention, we do not wish to be limited to specific details herein set forth but wish to reserve to ourselves any modifications and/or variations that might appear to those skilled in the art and which fall within the scope of the following claims:

Having described our invention, we claim:

1. A power torque wrench comprising an elongate rigid frame with front and rear ends and with laterally outwardly, upwardly and downwardly disposed sides, an elongate laterally extending output shaft with opposite ends rotatably carried by the frame at the front end portion thereof with its opposite ends accessible at opposite sides of the frame, a torque transmitting work engaging part at a selected one end of the shaft and projecting laterally outwardly from one side of the frame, power operated drive means carried by the frame and engaged with the shaft to rotate the shaft and said part; an elongate reaction anchoring means with an inner end pivotally connected with the rear end portion of the frame, an outer end spaced from the frame and including an elongate laterally extending axially shiftable and rotatable post on an axis parallel with and spaced from the shaft, support structure engaging parts at the ends of the post and projecting laterally outwardly from and accessible at the opposite sides of the frame.

2. The power torque wrench set forth in claim 1 wherein said reaction anchoring means includes elongate link means with inner and outer ends, post carrying structure at its outer end portion and mounting means pivotally connecting its inner end portion with the rear end portion of the frame whereby the link means is pivotally movable about the rear end portion of the frame.

3. The power torque wrench set forth in claim 2 wherein said link means include a pair of elongate laterally spaced parallel shackle plates, said post carrying structure comprises a body connected with and between outer ends of the plates and has a laterally extending opening in which the post is slidably engaged.

4. The power torque wrench set forth in claim 2 wherein said link means include a pair of elongate laterally spaced parallel shackle plates, said post carrying structure comprises a body connected with and between the outer ends of the plates and has a laterally extending opening in which the post is slidably engaged, said mounting means pivotally connecting the link means with the rear end portion of the frame includes a laterally extending pivot pin engaged with the inner end portion of each shackle plate and engaged with the frame.

5. The power torque wrench set forth in claim 2 wherein said link means includes a pair of elongate laterally spaced parallel shackle plates with outer ends carrying said post carrying structure and each having an inner end portion pivotally connected with a portion of the frame adjacent thereto by a laterally extending pivot pin carried by the frame and engaged therewith.

6. The power torque wrench set forth in claims 1, 2, 3, 4 or 5 wherein said shaft and post has axially extending laterally opening polygonal openings at its ends and said torque transmitting work engaging part and said support structure engaging parts are elongate laterally extending parts with polygonal inner ends engaged in the polygonal openings in the shaft and the post and have axially outwardly disposed work and support structure engaging outer end portions.

7. The power torque wrench set forth in claim 1 wherein said drive means includes a ratchet wheel engaged about and carried by the shaft, between the ends thereof a drive ring about the wheel and having an elongate lever arm projecting radially therefrom, radially and circumferentially spaced pawls pivotally carried by the ring and releasably engaging the wheel, a cylinder and ram unit with an elongate cylinder with a rear end pivotally connected with the rear end portion of the frame between the opposite sides thereof and a front end spaced rearwardly from the lever arm and an elongate ram shiftabley engaged in and projecting axially forwardly from the cylinder and coupling means pivotally coupling the front end of the ram with the outer end portion of the lever arm.

8. The power torque wrench set forth in claim 7 wherein said coupling means includes an elongate substantially rearwardly opening channel in the lever arm extending substantially radially outwardly relative to the axis of the shaft, a pair of laterally opening slots parallel with the channel and entering opposite sides of the lever arm and communicating with the channel, an elongate laterally extending pivot pin engaged through the front end of the ram and having opposite end portions slidably engaged in the slots; and locking means between the ends of the pivot pin and the lever arm releasably locking the ends of the pivot pin in selected position longitudinally of the slots whereby the effective length of the lever arm between the cylinder and ram unit and the shaft is adjusted and set.

9. The power torque wrench set forth in claim 8 wherein said reaction anchoring means includes elongate link means with inner and outer ends, post carrying structure at its outer end portion and mounting means pivotally connecting its inner end portion with the rear end portion of the frame.

10. The power torque wrench set forth in claim 9 wherein said link means include a pair of elongate laterally spaced parallel shackle plates, said post carrying structure comprises a body connected with and between the outer ends of the plates and having a laterally extending opening in which the post is slidably engaged.

11. The power torque wrench set forth in claim 10 wherein said post carrying structure comprises a body connected with and between the outer ends of the plates and has a laterally extending opening in which the post is slidably engaged, said mounting means includes a laterally extending pivot pin engaged with the inner end portion of each shackle plate and engaged with the frame.

12. The power torque wrench set forth in claim 8 wherein said link means includes a pair of elongate laterally spaced parallel shackle plates with outer ends carrying said post carrying structure and each having an inner end portion pivotally connected with a portion of the frame adjacent thereto by a laterally extending pivot pin carried by the frame and engaged therewith.

13. The power torque wrench set forth in claims 8, 9, 10, 11 or 12 wherein said shaft and post have axially extending laterally opening polygonal openings at their ends and said torque transmitting work engaging part and said support structure engaging part are elongate laterally extending parts with polygonal inner ends engaged in the polygonal openings in the shaft and the post and with axially outwardly disposed work and support structure engaging outer end portions.

* * * * *